United States Patent [19]

Mixon, Jr. et al.

[11] 4,128,058

[45] Dec. 5, 1978

[54] IGNITOR ASSEMBLY

[75] Inventors: James L. Mixon, Jr., Harrisburg; Walter M. Werner, Dowingtown, both of Pa.

[73] Assignee: AMP Incorporated, Harrisburg, Pa.

[21] Appl. No.: 806,570

[22] Filed: Jun. 14, 1977

[51] Int. Cl.[2] ..... F42C 19/12

[52] U.S. Cl. ..... 102/28 R; 102/46

[58] Field of Search ..... 102/28 R, 46

[56] References Cited

U.S. PATENT DOCUMENTS

| | | | |
|---|---|---|---|
| 1,108,717 | 8/1914 | Davis | 102/46 |
| 3,490,332 | 1/1970 | Damm | 102/46 |
| 3,681,512 | 8/1972 | Werner et al. | 102/28 R |
| 3,710,719 | 1/1973 | Werner | 102/28 R |

*Primary Examiner*—Verlin R. Pendegrass

*Attorney, Agent, or Firm*—Allan B. Osborne

[57] ABSTRACT

The present invention relates to an ignitor assembly useful for detonating a charge of powder in an explosively actuated electrical connector. More particularly the ignitor consists of a shell member having a filled chamber propellant with an electrical heating wire extending through it and a conductive body member having a shell member-receiving cavity. An electrical circuit for heating the wire includes the conductive body and the electrical connector.

2 Claims, 4 Drawing Figures

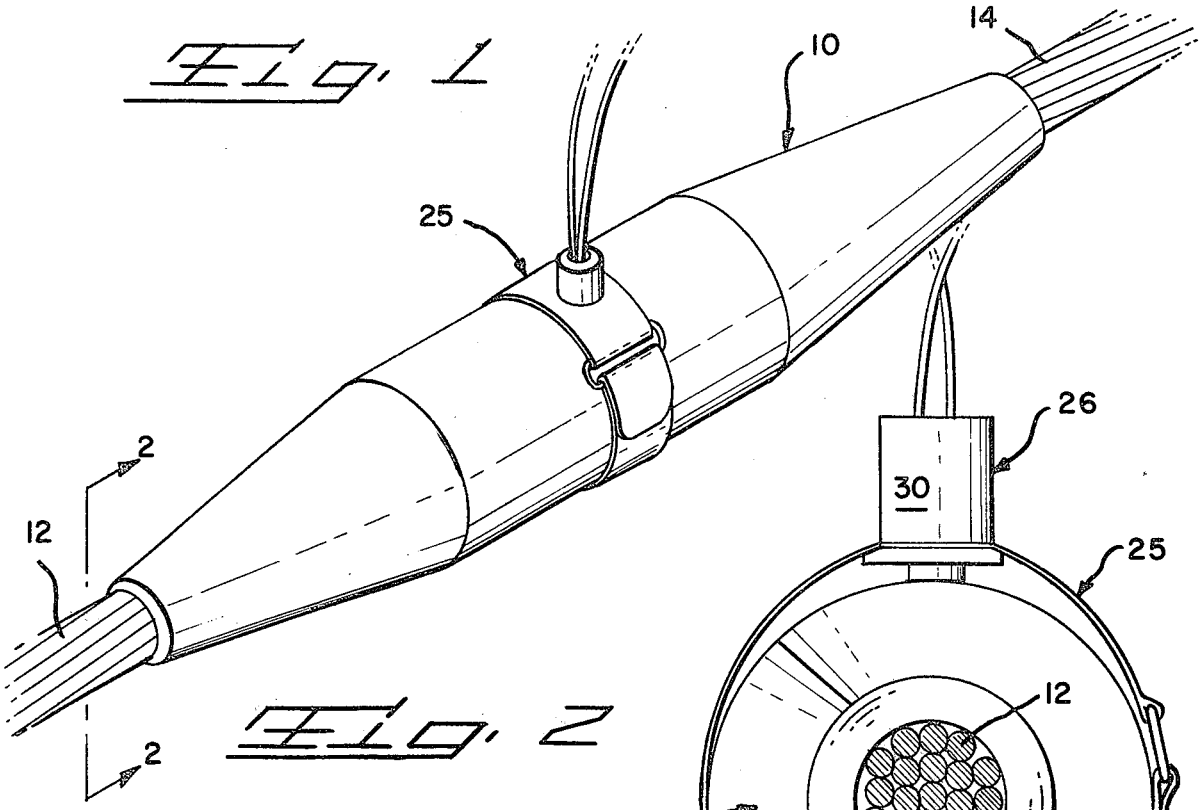
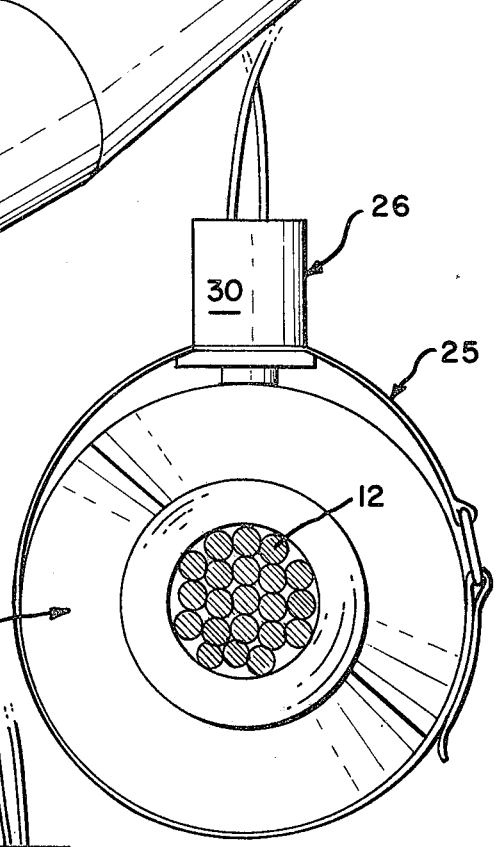
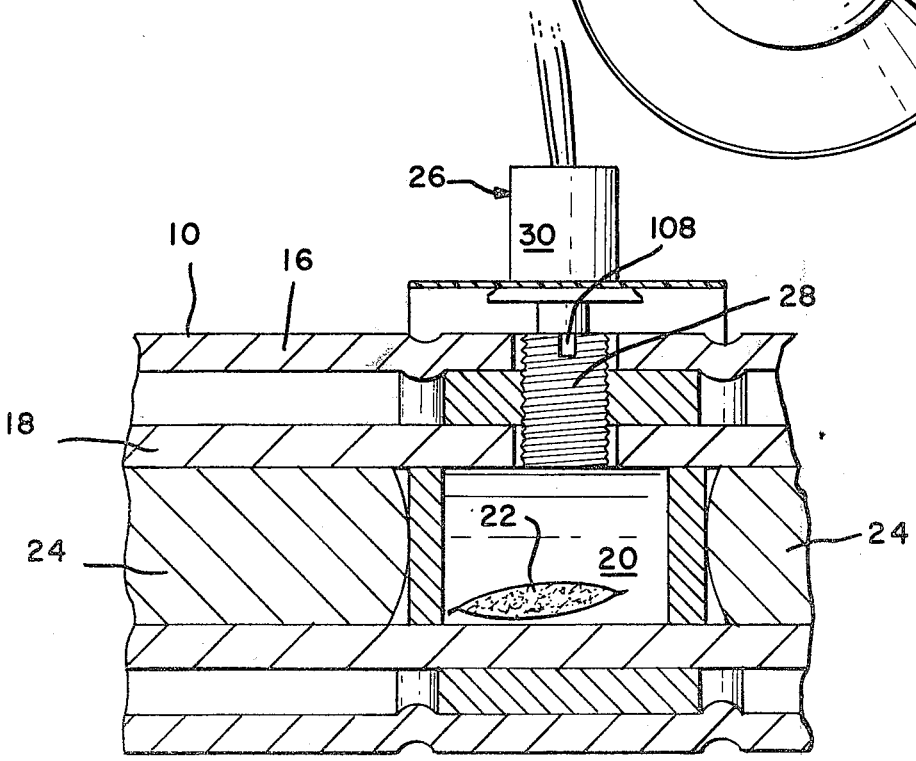
Fig. 3

IGNITOR ASSEMBLY

BACKGROUND OF THE INVENTION

1. Field Of The Invention

This invention relates to an ignitor assembly for igniting a charge of powder contained in an explosively operated electrical connector employed for securing large diameter cables either as a splice connector or as a terminal connector.

2. The Prior Art

U.S. Pat. No. 3,681,512 discloses the detonator heretobefore used in firing the powder containing in the electrical connector disclosed in the same patent. Extensive use of the prior art detonator indicated a need for an increase in propellant amount from 1.5 to 5 grains. Additionally the aforementioned detonator was used in conjunction with a coiled spring which when compressed formed a chamber and captured the flame therein. Thus, often the powder charge would not be ignited. Further, the detonator included a tapered member which reduced its shear and extrusion shape. Yet another problem was that the firing mechanism used to ignite the detonator could not be operated remotely.

SUMMARY OF THE INVENTION

The present invention includes a contact plug, a upper and lower housing members, a spring and a belt. The contact plug has a conductive center post and outer shell with insulating members in between so that an electrical current travels through the center post, through the heating wire buried in the propellant and out through the outer shell.

BRIEF DESCRIPTION OF THE DRAWINGS

FIG. 1 illustrates the adaption of the device of the present invention to a propellant-driven splicing device;

FIG. 2 is a cross-section taken along lines 2—2 of FIG. 1, viewing that assembly from an end thereof;

FIG. 3 is a segment of the splicing device of FIG. 1 in a side cross-section so as to illustrate the location of the device of the present invention therein.

DESCRIPTION OF THE PREFERRED EMBODIMENT

Figure 4:
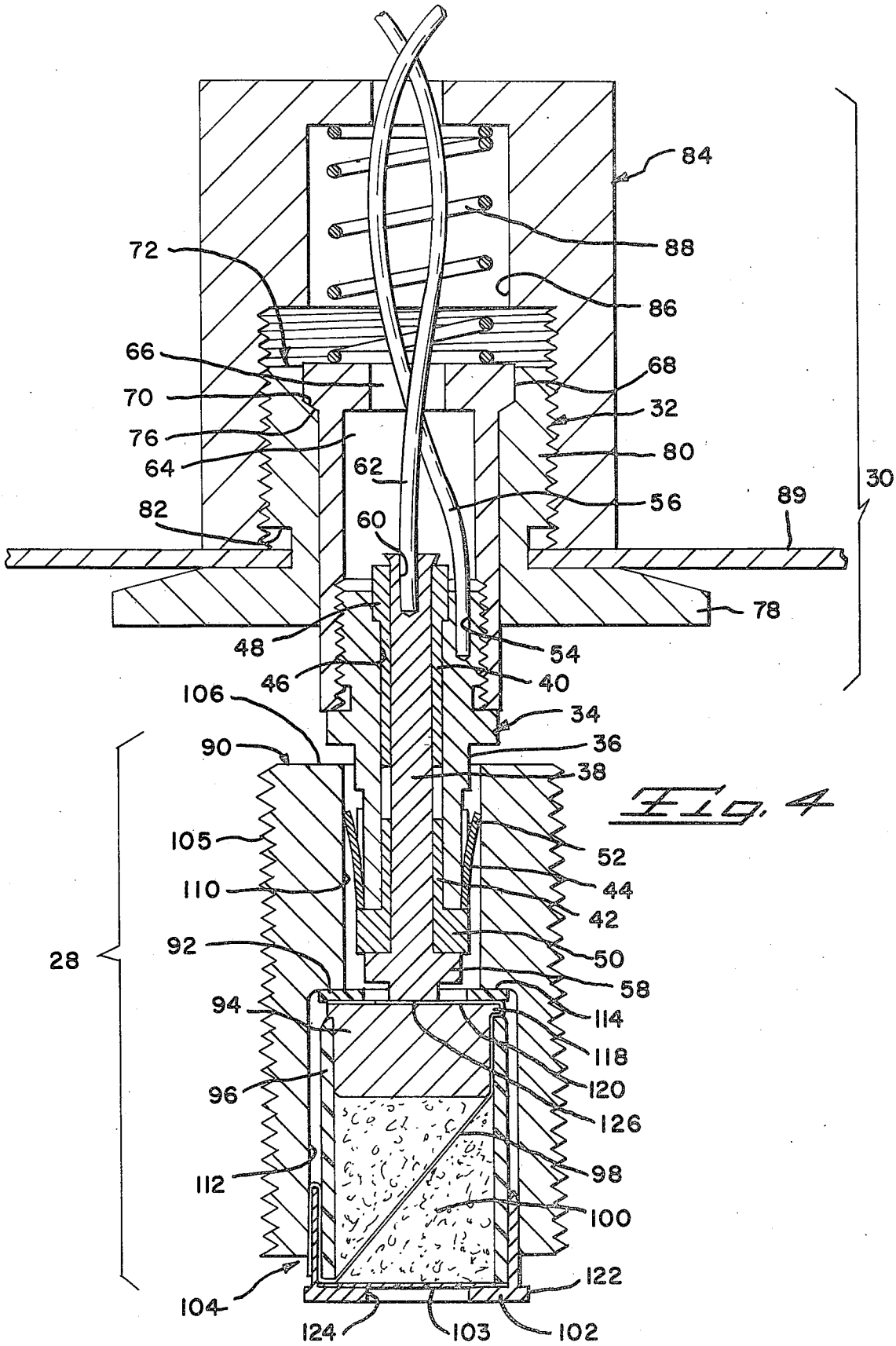
FIG. 4 is an elevational cross-section of the device of the present invention.

Reference numeral 10 points out a high voltage electrical connector for splicing cables 12 and 14 together. Referring also to FIG. 3 the connector 10, disclosed in U.S. Pat. No. 3,681,512, consists of an outer shell 16, an internal barrel 18 and a firing chamber 20. The powder 22, when ignited, drives pistons 24 which in turn drives a plurality of tapered jaws into a gripping engagement with the cables.

The method of igniting powder 22 includes a firing assembly 25 consisting of a remote firing collar subassembly 26 (FIG. 2) and an ignitor subassembly 28 (FIG. 3).

Reference is now directed to FIG. 4 which shows the assembly 25 and subassemblies 26 and 28 in cross-section.

The three major components of the remote firing collar subassembly 26 include a cylindrical housing 30, a contact member retainer bushing 32 and a contact member 34. The contact member is threaded into the lower portion of the bushing which in turn depends from the housing. The unit comprising the bushing and contact member enjoys limited vertical movement as will be explained below.

Contact member 34 has an outer shell 36 of brass or other conductive material, an inner or center post 38, also of a conductive material, an upper insulating sleeve 40, a lower insulating sleeve 42 and a conductive retaining ring 44.

The outer shell 36 has a passage 46 therethrough with an enlarged section at the top. The upper insulating sleeve 40 has a thickened end portion 48 which fills this enlarged section and also extends upwardly above the top of the shell. The rest of the sleeve extends down into passage 46. The lower insulating sleeve 42 has a thick end portion 50 which extends laterally beyond the perimeter of the outer shell at its lower end. The sleeve's elongated portion extends up into passage 46 towards sleeve 40.

The retaining ring 44 is positioned around the shell right above the insulating sleeve's outwardly projecting end portion 50. The ring has several spring fingers 52 around its periphery protruding up and outwardly.

The outer shell has an aperture 54 drilled into the top portion. This aperture receives the end of one wire 56 which is part of the electrical circuit.

The center post 38, which is positioned in passage 46 inside the insulating sleeves, has an annular rim 58 adjacent its lower end. The thick end portion 50 of the insulating sleeve electrically isolates the rim 58 from the end of the outer shell 36 and also from contact with the retaining ring. The top of the center post is flared as shown to fix the post in the passage. An aperture 60 in the top of the post receives an end of a second wire 62 which is also part of the electrical circuit.

Bushing 32 is cylindrical, with a cavity 64 occupying most ot its volume. The cavity, opening out on the base of the bushing has threads to which the contact member 34 is threaded after electrical wires 56 and 62 are inserted into their proper apertures. These wires having been previously fed through an opening in the housing and opening 66 in the top of the bushing.

The top of the bushing has a laterally extending rim 68 with the bottom shoulder 70 beveled inwardly. Bushing 32 is made from a nonconductive material.

As FIG. 4 shows, the bushing is slidingly positioned in the lower unit 72 of housing 30. The passage 74 in the lower unit has a corresponding beveled shelf 76 onto which the bushing rests. The lower unit has a wide circular base 78 and a smaller cylindrical upright member 80. A groove 82 is positioned between the upright member and base.

The cylindrical upper unit 84 of the housing is cup shaped with passage 86 therethrough. The passage consists of through portions, the first and largest opens out onto the base of the unit and it has threads to receive the lower unit as shown. The middle portion is smaller in diameter and provides a recess for coil spring 88. The coil spring biases bushing 32 downwardly in its seat in the lower unit. The third and smallest portion opens out on top of the upper unit and provides an entrance for wires 56 and 62. Housing 30 is nonconductive. Belt 89 provides the means for securing the subassembly 26 to connector 10. An opening in the belt has a diameter groove 82.

In assembly the subassembly 26, upper unit 84 is first slid onto wires 56 and 62 followed by coil spring 88, bushing 32, belt 89 and lower unit 72. After the wires are fixed into apertures 54 and 60 the contact member 34 is threaded into the bushing cavity 64. Thereafter the lower unit is threaded into the upper unit with belt 89 positioned in between as shown in the drawings.

Ignitor subassembly 28 consists of an ignitor body member 90, washer 92, ignitor cap 94, ignitor housing 96, ignitor wire 98, propellant 100 and end cap 102, and clear plastic window 103. The above elements with the exception of body member 90 and washer 92 constitutes shell member 104.

Ignitor body member 90, preferably made from cold drawn steel, has external threads 105. The upper surface 106 is shallowly bisected to provide a slot 108 (FIG. 3). A passage 110 extends longitudinally through the member. The lower portion of the passage is enlarged to provide a cavity 112 and a downwardly facing shoulder 114. Washer 92, is preferably made from polyethylene. The ignitor cap 94 is cylindrical with a laterally extending flange 118 on its top surface 120. The edge of its lower surface is beveled to facilitate inserting it into the ignitor housing. This cap is preferably made from cold drawn steel. Ignitor housing 96 is made from nylon and is simply a sleeve or tube. Ignitor wire 98 is preferably a wire sold under the tradename NI-CHROME by the Driver-Harris Company of Harrison, New Jersey. Propellant 100 is a powder sold under the tradename INFALLIBLE by Hercules Powder Company. End cap 102 is cup-shaped with a flange 122 on its lower edge and an aperture 124 extending through the cap's flat bottom surface. The cap is preferably made from aluminum. Clear plastic window 103 is made from polyethylene.

The ignitor subassembly 28 may be assembled by first assembling the shell. To begin, the wire 98 is placed through the housing 96 so that the wire ends extend out either end of the sleeve. The plastic window 103 and end cap 102 are then placed, in that order, over one end of the housing with the wire coming up the inside of the end cap side walls and down the outside as shown in FIG. 4. The inside dimensions of the end cap permit the housing to fit inside tightly. The plastic window covers the aperture 124 and further provides a gasket between the housing end and cap 102. After loading the housing with propellant 100, wire 98 is positioned so that it preferably cuts diagonally through the propellant as shown. Holding the loose end of the wire, ignitor cap 94 is pressed into the open end of the housing until its flange abuts the sleeve; the loose end of the wire must extend outside of the cap 94 as shown.

Wire 98 is bent so that it lays across the top surface 120 of cap 94. Ideally the wire should be in the center of the top surface. With body member 90 held upside-down, the washer 92 is dropped into the cavity 112 followed by the assembled shell member to complete the ignitor subassembly. The outer diameter of end cap side walls are dimensioned so that they, plus the interference by wire 98, results in an extremely tight fit in the cavity.

Subsequent to the construction of connector 10, ignitor subassembly 28 is threaded through outer shell 16 into chamber 20 by means of its threads 105 and mating threads in the connector. The slot 108 on the subassembly assists in this step.

Immediately prior to using connector 10, remote firing collar subassembly 26 is strapped onto the connector with the lower end of contact member 34 inserted into passage 110 as shown in FIG. 4. The end tip 126 of center post 38 contacts wire 98 and ignitor cap 94. The fingers 52 on retainer ring 44 centers the contact member 34 in the passage. The two wires 56 and 62 are then connected to a power source (not shown) and an electric current delivered to wire 98. As it well known, the current heats wire 98 which ignites propellant 100. It burns rapidly and melts window 103 so that the burning flame can reach and ignite powder 22 in firing chamber 20.

The current flows down center post from wire 62, through wire 98, into body member 90, through retainer ring 44, up outer shell 36 and out wire 56.

The foregoing detailed description has been given for clearness of understanding only, and no unnecessary limitations should be understood therefrom, as some modifications will be obvious to those skilled in the art.

What is claimed is:

1. A firing assembly for igniting a propellant contained in a chamber of an explosively actuated cable connector having an opening to the chamber, which comprises:

a. an ignitor subassembly comprising a conductive tubular body member having a passage therethrough, an insulated housing positioned in the lower part of the passage, said housing containing a propellant therein, a heating wire extending through the propellant with a first end being electrically contactable in said passage and a second end being in electrical contact with the tubular body member, said housing further having a covered aperture in the base thereof with the covering being flammable, said ignitor subassembly being positionable in the opening with the aperture adjacent to the chamber;

b. a remote firing subassembly comprising:

i. a contact member having a conductive outer shell with a conductive center post positioned therein and electrically isolated therefrom with the lower end of the post extending below the lower end of the shell, ii. a retaining bushing connected to the top of the outer shell so that the contact member depends therefrom, iii. a housing comprising upper and lower units joined together with an aligned passage therethrough, and with the retaining bushing slidably mounted in the passage in the housing with a coil spring in the passage biasing the bushing downwardly, c. belt means for holding the remote firing subassembly on the connector with the contact member in the passage of the tubular body member with the center post in electrical contact with the first end of the heating wire and the outer shell in electrical contact with the second end of the heating wire via the tubular body member; and d. first and second electrical wires connectable at one end to a power source, the first wire being connected to the center post and the second wire being connected to the outer shell so that a current may flow through the heating wire from the first wire and to the second wire through the tubular body member whereby the heating wire becomes hot and ignites the propellant with the flames therefrom burning through the covering and igniting the propellant in the chamber.

2. The firing assembly of claim 1 further including a retaining ring having upwardly extending fingers positioned around the outer shell whereby said contact member may be centrally positioned and removably retained in the passage of the tubular body member.

* * * * *